US010287073B2

(12) United States Patent
Zammit et al.

(10) Patent No.: US 10,287,073 B2
(45) Date of Patent: May 14, 2019

(54) CARTON WITH TAMPER RESISTANT FEATURES

(71) Applicant: Graphic Packaging International, Inc., Atlanta, GA (US)

(72) Inventors: Mark Zammit, Douglasville, GA (US); Elias Spartis, Roswell, GA (US)

(73) Assignee: Graphic Packaging International, LLC, Atlanta, GA (US)

( * ) Notice: Subject to any disclaimer, the term of this patent is extended or adjusted under 35 U.S.C. 154(b) by 390 days.

(21) Appl. No.: 14/733,238

(22) Filed: Jun. 8, 2015

(65) Prior Publication Data

US 2015/0353252 A1 Dec. 10, 2015

Related U.S. Application Data

(60) Provisional application No. 61/997,789, filed on Jun. 10, 2014.

(51) Int. Cl.
*B65D 71/00* (2006.01)
*B65D 71/58* (2006.01)

(52) U.S. Cl.
CPC .. *B65D 71/0022* (2013.01); *B65D 2571/0066* (2013.01); *B65D 2571/00141* (2013.01);
(Continued)

(58) Field of Classification Search
CPC ..... B65D 71/0022; B65D 2571/00802; B65D 2571/00314; B65D 2571/00141; B65D 2571/00956; B65D 2571/00475; B65D 2571/0066; B65D 71/00; B65D 71/12; B65D 75/00; B65D 71/64; B65D 71/0051
USPC ..... 206/427, 162, 170, 200, 192, 193, 194, 206/195, 196, 197, 198, 139, 156, 157, 206/159, 165, 175, 174, 763, 589, 158, 206/184, 167, 434, 180, 168; 229/89, 229/934, 914, 904
See application file for complete search history.

(56) References Cited

U.S. PATENT DOCUMENTS 1,968,877 A 8/1934 Cubberley
2,225,822 A 12/1940 Crook
(Continued)

FOREIGN PATENT DOCUMENTS

AR 78777 12/2008
CA 2 216 515 8/1997
(Continued)

*Primary Examiner* — Jacob K Ackun
*Assistant Examiner* — Jenine Pagan
(74) *Attorney, Agent, or Firm* — Womble Bond Dickinson (US) LLP

(57) ABSTRACT

A carrier for holding a plurality of containers. The carrier has a bottom panel, at least one front panel, at least one back panel, at least two side panels, and at least one central panel dividing the interior of the carrier into a front portion and a back portion. At least one front divider flap is foldably connected to the at least one central panel and at least one back divider flap is foldably connected to the at least one central panel. At least one retention flap is foldably connected to at least one of the at least one front panel, the at least one back panel, the at least two side panels, and the at least one central panel. The at least one retention flap engages a container and provides stability to the respective container in one of the front or back container-receiving spaces.

18 Claims, 10 Drawing Sheets

(52) U.S. Cl.
CPC ..... *B65D 2571/00314* (2013.01); *B65D 2571/00475* (2013.01); *B65D 2571/00802* (2013.01); *B65D 2571/00956* (2013.01)

(56) References Cited

U.S. PATENT DOCUMENTS 2,227,330 A 12/1940 Turner
2,296,937 A * 9/1942 Lyons, Jr. ..... B65D 71/0037 206/168
2,324,771 A 7/1943 Fiore
2,331,312 A 10/1943 Dorfman
2,336,857 A 12/1943 Gies et al.
2,345,567 A 4/1944 Arneson
2,384,480 A 9/1945 Lupton
2,417,421 A 3/1947 Koolnis
2,446,161 A 7/1948 Price
2,522,950 A 9/1950 Keith
2,558,618 A 6/1951 Lebold
2,563,065 A 8/1951 Price
2,689,061 A 9/1954 Gray
2,783,916 A 3/1957 Hodapp
2,794,571 A 6/1957 Fielding
2,804,234 A 8/1957 Lachance
2,808,177 A * 10/1957 Buttery ..... B65D 71/0022 206/175
2,860,771 A * 11/1958 Spiegel, Jr. ..... B65D 71/0007 206/158
2,950,854 A 8/1960 Ganz
3,053,411 A 9/1962 Struble et al.
3,190,487 A 6/1965 Wood
3,191,800 A 6/1965 Kowal
3,229,849 A 1/1966 Spillson
3,236,414 A 2/1966 Slevin, Jr.
3,355,012 A 11/1967 Weiss
3,386,570 A 6/1968 Lock
3,394,800 A * 7/1968 Brackett ..... B65D 71/38 206/147
3,669,306 A 6/1972 Forrer
3,670,950 A 6/1972 Rossi
3,744,704 A 7/1973 Struble
3,820,657 A 6/1974 Klygis et al.
3,884,353 A 5/1975 Forte
3,917,061 A 11/1975 Stout
4,101,069 A 7/1978 Wood
4,146,168 A 3/1979 Hartline
4,155,502 A 5/1979 Forte
4,171,046 A 10/1979 Bonczyk
4,205,748 A 6/1980 Wilson
4,234,114 A 11/1980 Wood
4,243,138 A 1/1981 Wilson
4,284,195 A 8/1981 Champlin
4,308,950 A 1/1982 Wood
4,326,628 A 4/1982 Wood
4,362,240 A 12/1982 Elward
4,374,561 A 2/1983 Stout et al.
4,413,729 A 11/1983 Wood
4,424,901 A 1/1984 Lanier
4,450,956 A 5/1984 Wood
4,480,746 A 11/1984 Wood
4,533,047 A 8/1985 Calvert
4,601,390 A 7/1986 Rosenthal et al.
4,708,284 A 11/1987 Sutherland et al.
4,722,437 A 2/1988 Walsh
4,792,038 A 12/1988 Cooper
4,927,009 A 5/1990 Stout
5,040,672 A 8/1991 DeMaio et al.
5,167,325 A 12/1992 Skora
5,234,103 A * 8/1993 Schuster ..... B65D 71/243 206/158
5,392,984 A 2/1995 Yocum
5,437,363 A 8/1995 Gungner
5,458,234 A 10/1995 Harris
5,484,053 A 1/1996 Harris
5,485,915 A 1/1996 Harris
5,499,712 A 3/1996 Harrelson
5,531,319 A 7/1996 Harrelson
5,538,130 A 7/1996 Harrelson
5,538,131 A 7/1996 Harrelson
5,549,197 A 8/1996 Sutherland
5,590,762 A 1/1997 Harrelson
5,590,776 A * 1/1997 Galbierz ..... B65D 71/48 206/153
5,593,027 A 1/1997 Sutherland
5,595,291 A 1/1997 Negelen
5,624,024 A 4/1997 Miess
5,649,620 A 7/1997 Harrelson
5,657,864 A 8/1997 Harrelson
5,657,865 A 8/1997 Harrelson
5,682,982 A 11/1997 Stonehouse
5,695,051 A 12/1997 Hart
5,775,487 A 7/1998 Harrelson
5,803,264 A 9/1998 Gersten et al.
5,871,090 A 2/1999 Doucette et al.
5,878,877 A 3/1999 Sutherland
5,947,273 A 9/1999 Dalrymple et al.
5,979,747 A 11/1999 Gnadt et al.
6,131,729 A 10/2000 Eckermann et al.
6,155,962 A 12/2000 Dalrymple et al.
6,230,882 B1 5/2001 Wischusen, III
6,315,111 B1 * 11/2001 Sutherland ..... B65D 71/0055 206/188
6,341,689 B1 1/2002 Jones
6,371,287 B1 4/2002 Jones et al.
6,598,739 B1 7/2003 Collura
6,695,137 B2 2/2004 Jones et al.
6,736,260 B2 5/2004 Gomes et al.
6,896,130 B2 5/2005 Theelen
6,938,756 B2 9/2005 Schuster
7,011,209 B2 3/2006 Sutherland et al.
7,134,547 B2 11/2006 Auclair
7,185,758 B2 3/2007 Cuomo
7,243,785 B2 7/2007 Cuomo
7,267,224 B2 9/2007 Cuomo
7,357,247 B2 4/2008 Guenther
7,370,755 B2 5/2008 Cuomo
7,374,038 B2 5/2008 Smalley
7,578,385 B2 8/2009 Holley, Jr.
7,604,115 B2 10/2009 Cuomo
7,677,387 B2 3/2010 Brand et al.
8,091,702 B1 1/2012 Keip
8,424,677 B2 4/2013 Spivey, Sr. et al.
8,622,207 B2 1/2014 Smalley
2003/0111363 A1 6/2003 Theelen
2003/0159950 A1 8/2003 Jones et al.
2003/0213705 A1 11/2003 Woog
2004/0094435 A1 5/2004 Auclair et al.
2005/0103651 A1 5/2005 Lebras
2005/0230273 A1 10/2005 Kohler
2007/0029212 A1 2/2007 Smalley
2009/0008273 A1 1/2009 Smalley

FOREIGN PATENT DOCUMENTS

DE 9004439 6/1990
EP 0 452 563 10/1991
EP 1 319 607 6/2003
EP 1 348 638 10/2003
FR 1 447 208 7/1966
GB 2 279 065 12/1994
WO WO 97/05026 2/1997
WO WO 98/19932 5/1998
WO WO 2005/044687 5/2005

* cited by examiner

CARTON WITH TAMPER RESISTANT FEATURES

CROSS-REFERENCE TO RELATED APPLICATIONS

This application claims the benefit of U.S. Provisional Patent Application No. 61/997,789, filed Jun. 10, 2014.

INCORPORATION BY REFERENCE

The disclosure of U.S. Provisional Patent Application No. 61/997,789, which was filed Jun. 10, 2014, is hereby incorporated by reference as if presented herein in its entirety

BACKGROUND OF THE DISCLOSURE

The present disclosure generally relates to carriers or cartons for holding and displaying containers. More specifically, the present disclosure relates to a carton having tamper resistant features.

SUMMARY OF THE DISCLOSURE

In general, one aspect of the disclosure is directed to a carrier for holding a plurality of containers. The carrier has a plurality of panels that extend at least partially around an interior of the carrier. The plurality of panels include a bottom panel, at least one front panel, at least one back panel, at least two side panels, and at least one central panel dividing the interior of the carrier into a front portion and a back portion. At least one front divider flap is foldably connected to the at least one central panel and extending to the at least one front panel to divide the front portion into at least one front container-receiving space. At least one back divider flap is foldably connected to the at least one central panel and extending to the at least one back panel to divide the back portion into at least one back container-receiving space. At least one retention flap foldably connected to at least one of the at least one front panel, the at least one back panel, the at least two side panels, and the at least one central panel. The at least one retention flap engages a respective container of the plurality of containers and provides stability to the respective container in one of the at least one front container-receiving space and at least one back container-receiving space.

In another aspect, the disclosure is generally directed to a blank for forming a carrier for holding a plurality of containers. The blank includes a plurality of panels. The plurality of panels include a bottom panel, at least one front panel, at least one back panel, at least two side panels, and at least one central panel for dividing the interior of the carrier into a front portion and a back portion when the carrier is formed from the blank. At least one front divider flap is foldably connected to the at least one central panel and configured to extend to the at least one front panel to divide the front portion into at least one front container-receiving space when the carrier is formed from the blank. At least one back divider flap is foldably connected to the at least one central panel and configured to extend to the at least one back panel to divide the back portion into at least one back container-receiving space when the carrier is formed from the blank. At least one retention flap foldably connected to at least one of the at least one front panel, the at least one back panel, the at least two side panels, and the at least one central panel. The at least one retention flap is configured to engage a respective container of the plurality of containers and provide stability to the respective container in one of the at least one front container-receiving space and at least one back container-receiving space when the carrier is formed from the blank.

In another aspect, the disclosure is generally directed to a method of forming a carrier for containing a plurality of containers. The method includes obtaining a blank having a bottom panel, at least one front panel, at least one back panel, at least two side panels, and at least one central panel. At least one front divider flap is foldably connected to the at least one central panel, at least one back divider flap foldably connected to the at least one central panel, and at least one retention flap is foldably connected to at least one of the at least one front panel, the at least one back panel, the at least two side panels, and the at least one central panel. The method further includes forming the interior, dividing the interior into a front portion and a back portion with the at least one central panel, and dividing the front portion into at least one front container-receiving space by positioning the at least one front divider flap so that the at least one divider flap extends to the front panel and dividing the back portion into at least one back container receiving space by positioning the at least one back divider flap so that the at least one back divider flap extends to the back panel. The method further includes engaging the at least one retention flap with a respective container of the plurality of containers.

BRIEF DESCRIPTION OF THE DRAWINGS

Those skilled in the art will appreciate the above stated advantages and other advantages and benefits of various additional embodiments reading the following detailed description of the embodiments with reference to the below-listed drawing figures. It is within the scope of the present disclosure that the above-discussed aspects be provided both individually and in various combinations.

According to common practice, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION OF THE EXEMPLARY EMBODIMENT

The present disclosure generally relates to carriers, packages, constructs, sleeves, cartons, or the like, for holding and displaying containers such as jars, bottles, cans, etc. The containers can be used for packaging food and beverage products, for example. The containers can be made from materials suitable in composition for packaging the particular food or beverage item, and the materials include, but are not limited to, plastics such as PET, LDPE, LLDPE, HDPE, PP, PS, PVC, EVOH, and Nylon; and the like; aluminum and/or other metals; glass; or any combination thereof.

Carriers according to the present disclosure can accommodate containers of numerous different shapes. For the purpose of illustration and not for the purpose of limiting the scope of the disclosure, the following detailed description describes beverage containers (e.g., glass bottles or plastic containers) at least partially disposed within the carrier embodiments. In this specification, the terms "lower," "bottom," "upper," "top," "front," and "back" indicate orientations determined in relation to fully erected carriers.

Figure 1:
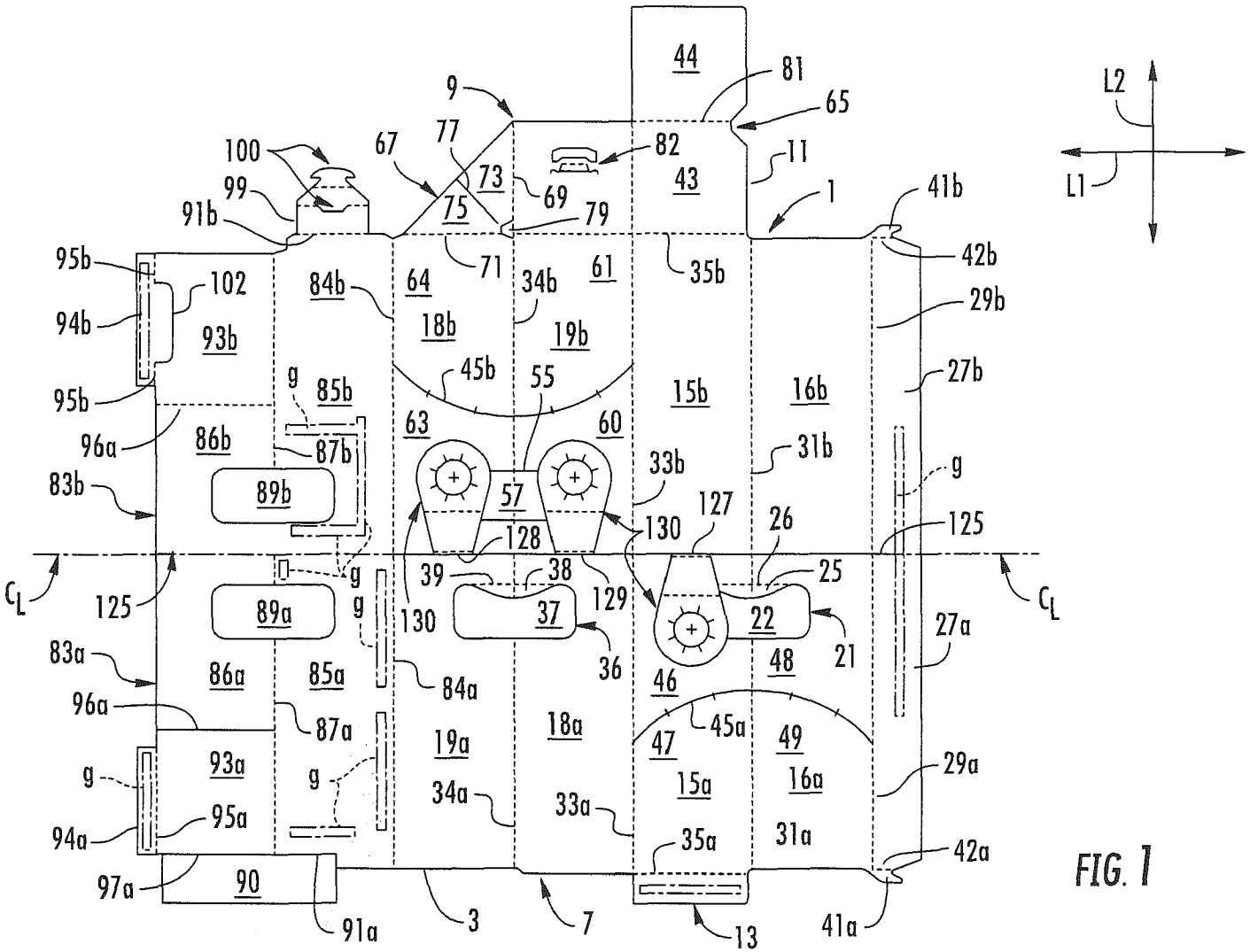
FIG. 1 is a plan view of an exterior of a carton blank used to form an exemplary basket-style carrier according to one embodiment of the disclosure.
Figure 9:
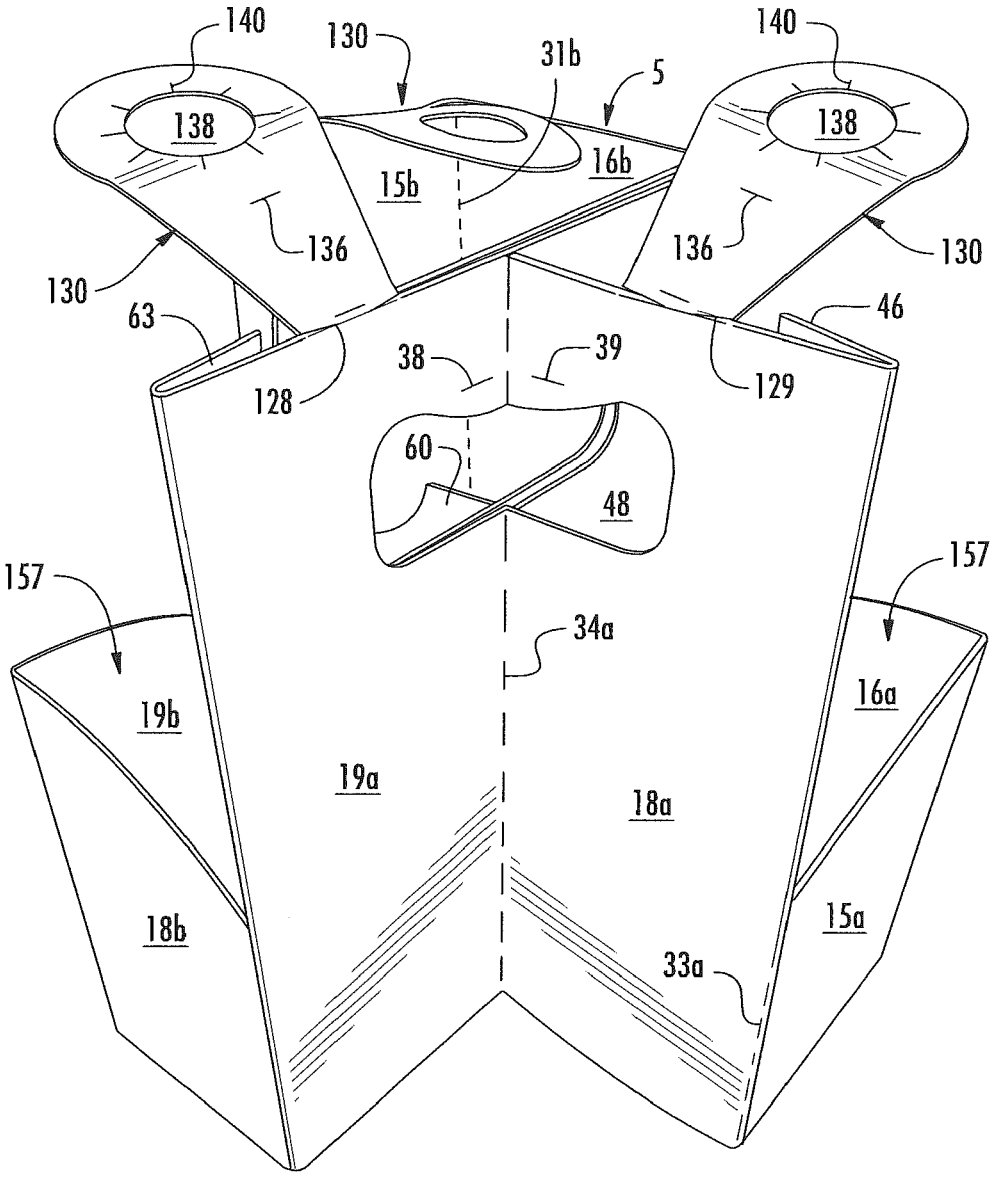
FIGS. 9 and 10 are perspective views of the exemplary basket-style carrier according to one embodiment of the disclosure.
Figure 10:
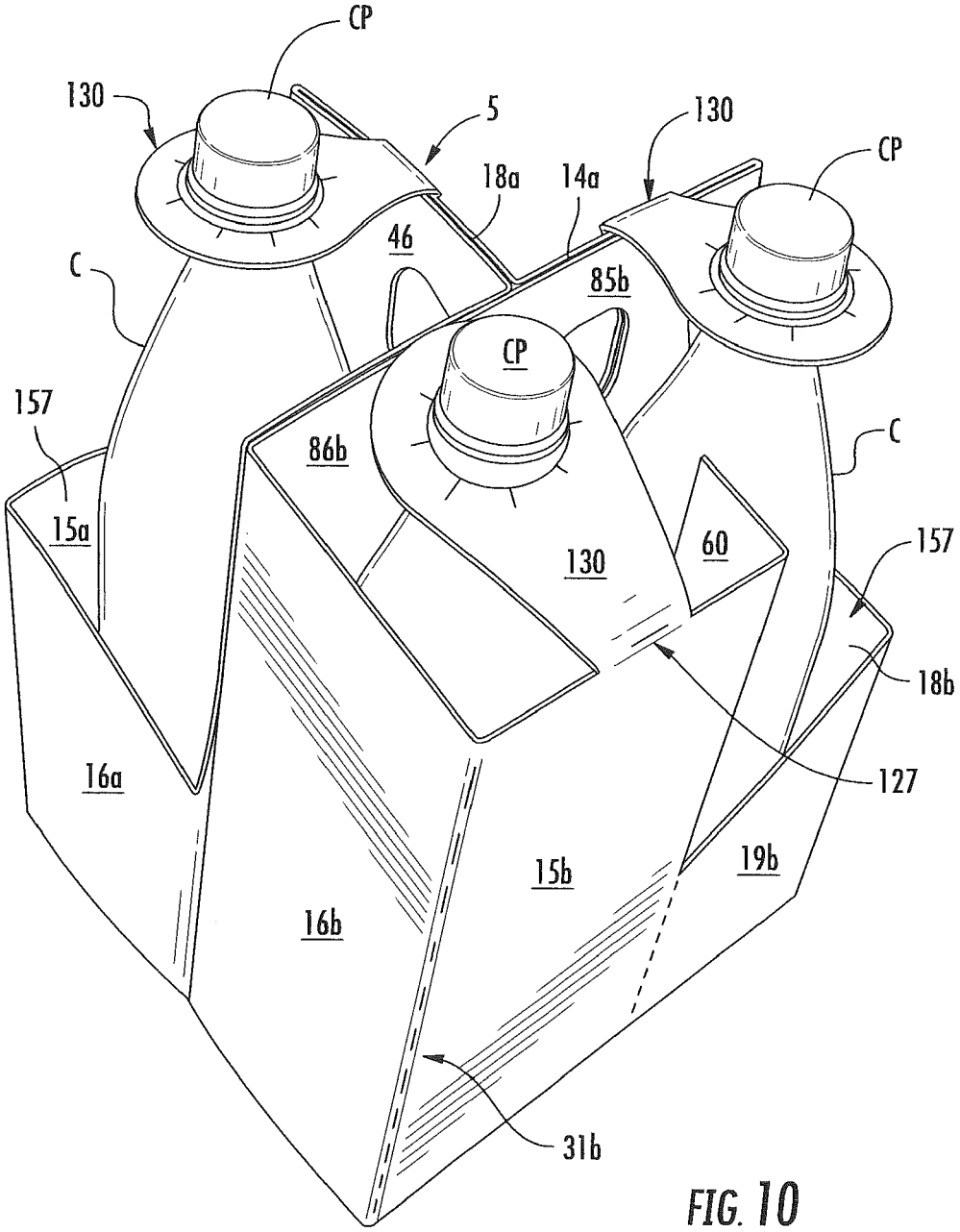

FIG. 1 is a plan view of an exterior side 1 of a blank 3 used to form a package or basket-style carrier 5 (FIG. 10), in accordance with an exemplary embodiment of the present disclosure. As shown in FIGS. 9 and 10, the carrier 5 is sized to contain three containers C, one containers being contained in a front portion of the carrier and two containers being contained in a back portion of the carrier. The carrier may be sized and shaped to hold more or less than three containers.

The blank 3 has a longitudinal axis L1 and a lateral axis L2. The blank 3 has a front portion 7, a back portion 9, a bottom panel 11 foldably connected to the back portion, and a bottom adhesive flap 13 foldably connected to the front portion. In the illustrated embodiment, the front portion 7 and back portion 9 are for being folded about a longitudinal centerline CL when the blank 3 is formed into the carrier 5. As discussed in more detail below, the blank 3 is formed into the carrier 5 by folding the blank about the centerline CL so that the front portion 7 and the back portion 9 are overlapped.

In the illustrated embodiment, the front portion 7, comprises a first front panel 15*a* foldably connected to a first side panel 16*a* and a second side panel 18*a*. The second side panel 18*a* is foldably connected to a second front panel 19*a*. The front portion 7 includes a first handle 21 located in the first front panel 15*a* and first side panel 16*a*. The first handle 21 includes a handle opening 22 and a handle flap 25 foldably connected to the first front panel 15*a* and first side panel 16*a* at a longitudinal fold line 26. The front portion 7 includes a second handle 36 located at least partially in the second front panel 19*a* and second side panel 18*a*. The second handle 36 includes a handle opening 37 and a handle flap 38 foldably connected to the second front panel 19*a* and second side panel 18*a* at a longitudinal fold line 39. A central panel flap 27*a* is foldably connected to the first side panel 16*a* at a lateral fold line 29*a*. A hook portion 41*a* is foldably connected to the central panel at a longitudinal fold line 42*a*. Lateral fold lines 31*a*, 33*a*, foldably connect respective first and second side panels 16*a*, 18*a* to first front panel 15*a*. Lateral fold line 34*a* foldably connects second side panel 18*a* to the second front panel 19*a*. A longitudinal fold line 35*a* connects the bottom panel adhesive flap 13 to the first front panel 15*a*.

In one embodiment, the front portion 7 comprises an arcuate cut line 45*a* that extends across the first front panel 15*a* and first side panel 16*a* and terminates at lateral fold lines 33*a* and 29*a*. The arcuate cut line 45*a* divides the first front panel 15*a* into an upper portion 46 and a lower portion 47; and first side panel 16*a* into an upper portion 48 and a lower portion 49. The arcuate cut line 45*a* may be arranged or shaped differently, such as substantially straight or angled without departing from the disclosure.

In the illustrated embodiment, the back portion 9, comprises a first back panel 15*b* foldably connected to a third side panel 16*b* and a second back panel 19*a*. The second back panel 19*b* is foldably connected to a fourth side panel 18*b*. The back portion 9 includes a handle 55 located in the second back panel 19*b* and fourth side panel 18*a*. The handle 55 includes a handle opening 57. A central panel flap 27*b* is foldably connected to the third side panel 16*b* at a lateral fold line 29*b*. Lateral fold lines 31*b*, 33*b* foldably connect respective first side panel 16*b* and second back panel 19*b* to first back panel 15*b*. Lateral fold line 34*b* foldably connects fourth side panel 18*b* to the second back panel 19*b*. A longitudinal fold line 35*b* connects the bottom panel 11 to the first and second back panels 15*b*, 19*b*.

In one embodiment, the back portion 9 comprises an arcuate cut line 45*b* that extends at least partially across the second back panel 19*b* and fourth side panel 18*b* and terminates at lateral fold lines 33*b* and 84*b*. The arcuate cut line 45*b* divides the second back panel 19*b* into an upper portion 60 and a lower portion 61; and second side panel 18*b* into an upper portion 63 and a lower portion 64. The arcuate cut line 45*b* may be arranged, shaped differently, such as substantially straight or angled without departing from the disclosure.

In one embodiment, the bottom panel 11 may have a first portion 43 foldably connected to a second portion 44 at a longitudinal fold line 81. The first portion 43 may have female locking features 82 configured to accept male locking features and hold the carrier together when the carrier is formed from the blank. The bottom panel 11 may also have a notch 65 for receiving the hooks 41*a*, 41*b*. A gusset 67 is formed in the blank 3 and foldably connected to the first portion 43 of the bottom panel 11 at lateral fold line 69 and to the fourth side panel 18*b* at a longitudinal fold line 71. The gusset 67 comprises a first gusset panel 73 foldably connected to a second gusset panel 75 at an oblique fold line 77. An aperture 79 may be located at the inside corner of the gusset 67 adjacent the first portion 43 of the bottom panel 11 and the fourth side panel 18*b* without departing from the disclosure.

In one embodiment, the front portion 7 includes a front central panel 83*a* foldably connected to the second front panel 19*a* at a lateral fold line 84*a*. The front central panel 83*a* has a first portion 85*a* foldably connected to a second portion 86*a* at a lateral fold line 87*a*. The front central panel 83*a* includes a handle opening 89*a* located in the first and second portions 85*a*, 86*a* of the central panel 83*a*. A keel 90 is foldably connected to the first portion 85*a* of central panel 83*a* at a longitudinal fold line 91. A front divider flap 93*a* is foldably connected to the first portion 85*a* of the front central panel 83*a* at the lateral fold line 87*a* and is at least partially defined by an upper longitudinal cut 96*a* and a lower longitudinal cut 97*a*. An adhesive flap 94*a* is foldably connected to the front divider flap 93*a* at lateral fold line 95*a*.

The back portion 9 includes a back central panel 83*b* foldably connected to the fourth side panel 18*b* at a lateral fold line 84*b*. The back central panel 83*b* has a first portion 85*b* foldably connected to a second portion 86*b* at a lateral fold line 87*b*. The back central panel 83*b* includes a handle opening 89*b* located in the first and second portions 85*b*, 86*b* of the central panel 83*b*. An attachment flap 99 is foldably connected to the first portion 85*b* of central panel 83*b* at a longitudinal fold line 91*b*. As illustrated in FIG. 1, the attachment flap 99 has male locking features 100 that are configured to mate with the female locking features located in first portion 43 of the bottom panel 11 and hold the carrier 5 together when the carrier is formed from the blank 3. A back divider flap 93*b* is foldably connected to the first portion 85*b* of the back central panel 83*b* at the lateral fold line 87*b* and at least partially defined by an upper cut 96*b* and a lateral edge of the blank 3. An adhesive flap 94*b* is foldably connected to the back divider flap 93*b* at lateral fold lines 95*b* and partially defined by cuts 102.

In the illustrated embodiment, the blank 3 includes a longitudinal fold line 125 that foldably connects the front central panel 83*a* and the back central panel 83*b* and the central panel flap 27*a* to the back central panel flap 27*b*. The longitudinal fold line 125 is aligned with the longitudinal centerline CL of the blank 3.

Figure 2:
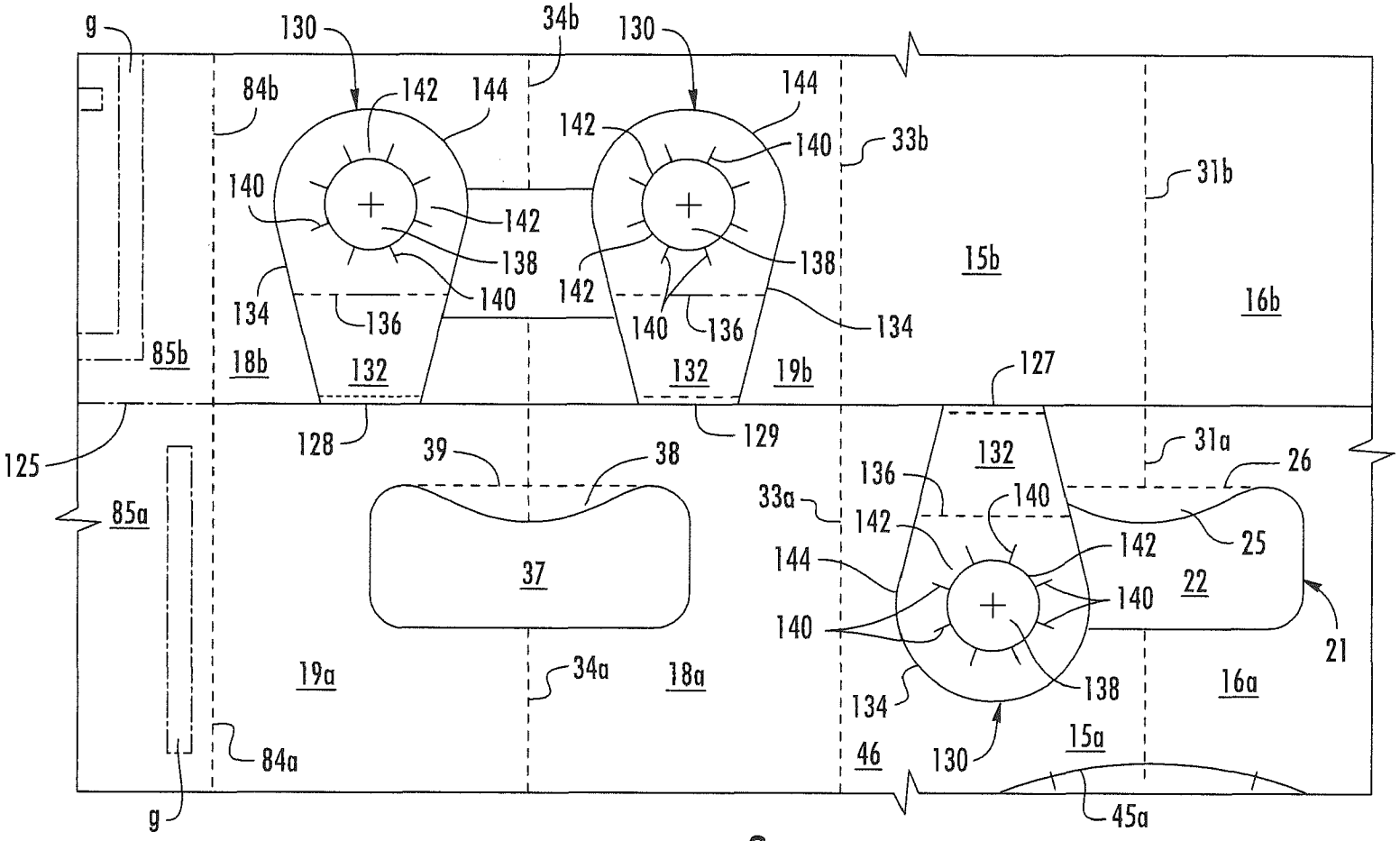
FIG. 2 is a detailed view of the tamper resistant features according to one embodiment of the disclosure.

As shown in FIG. 2, the front portion 7 has a tamper resistant retention flap 130 foldably connected to the first back panel 15*b* at fold line 127. The retention flap 130 has a first portion 132 foldably connected to a second portion 134 at a longitudinal fold line 136. The first portion 132 may have trapezoidal, isosceles trapezoid, square, or any other shape without departing from the disclosure. The second portion 134 may have a generally curved shape and an aperture 138 with cuts 140 that are circumferentially located around and extend radially outward from the center of the aperture 138 The cuts 140 define tab portions 142 and the aperture 138 is generally sized to securely hold the neck portion of a container C, for example, as shown in FIG. 10. The tab portions 142 flex or bend providing clearance for the cap portion CP of the container C to pass there through. The tab portions 142 provide container removal resistance and indicated if someone or something has been tampering with the container. The retention flap 130 is defined by cut line 144 in the upper portion 46 of the first front panel 15*a* and may extend at least partially into the handle 21. The retention flap may be alternatively shaped or arranged without departing from the disclosure.

In one embodiment, the second side panel 18*b* and second back panel 19*b* each have a tamper resistant retention flap 130 as described above defined therein. The retention flap 130 of the second side panel 18*b* is foldably connected to the second front panel 19*a* at fold line 128. The retention flap 130 of the second back panel 19*b* is foldably connected to the second side panel 18*a* at fold line 129.

Any of the panels, flaps, fold lines, cuts, or other features could be otherwise shaped, arranged, and/or omitted from the blank 3 without departing from the disclosure. The blank 3 could be sized and/or shaped to accommodate more or less than three containers without departing from this disclosure.

Figure 3:
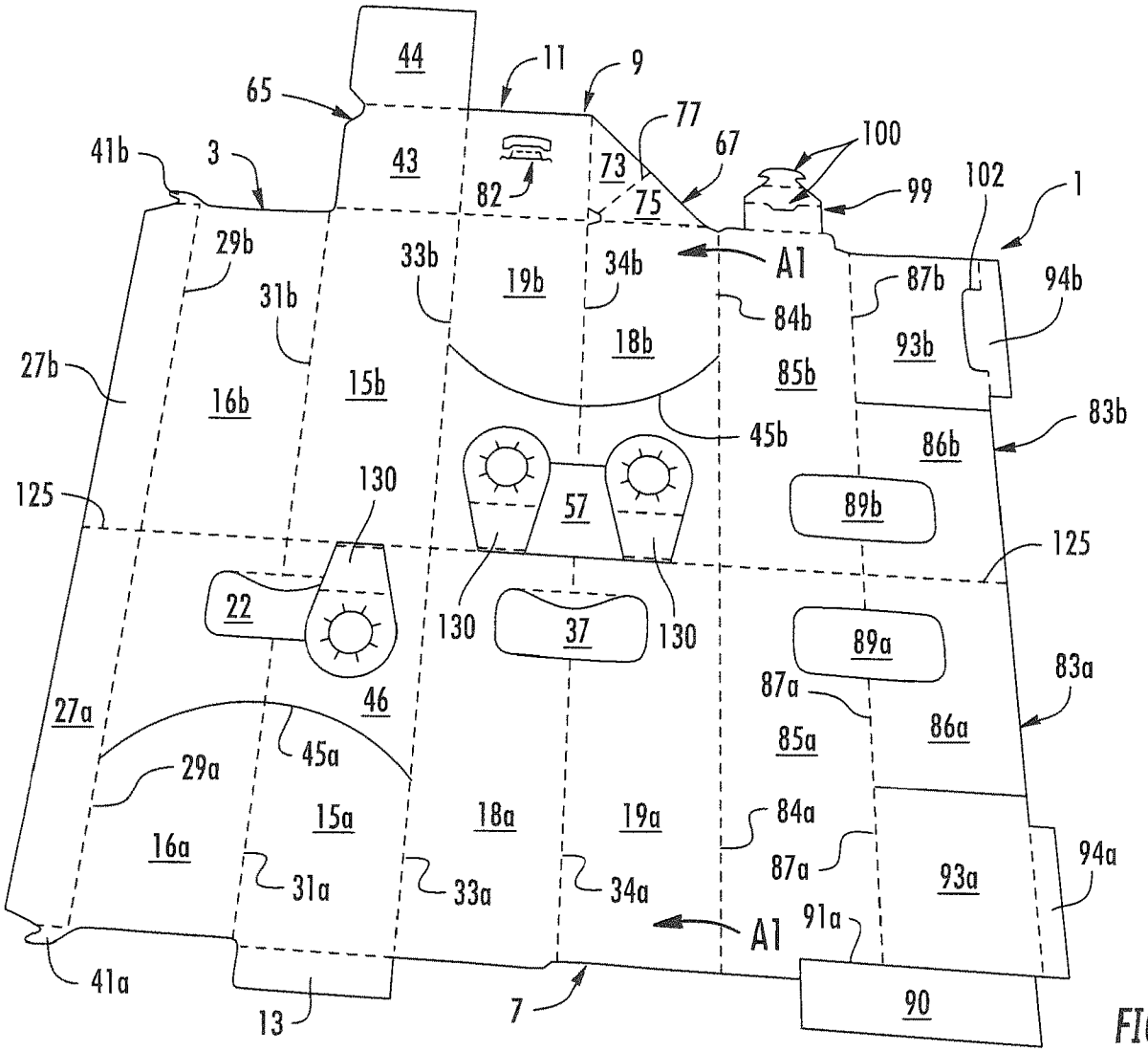
FIG. 3 is a perspective view of the interior of the carton blank of FIG. 1.
Figure 4:
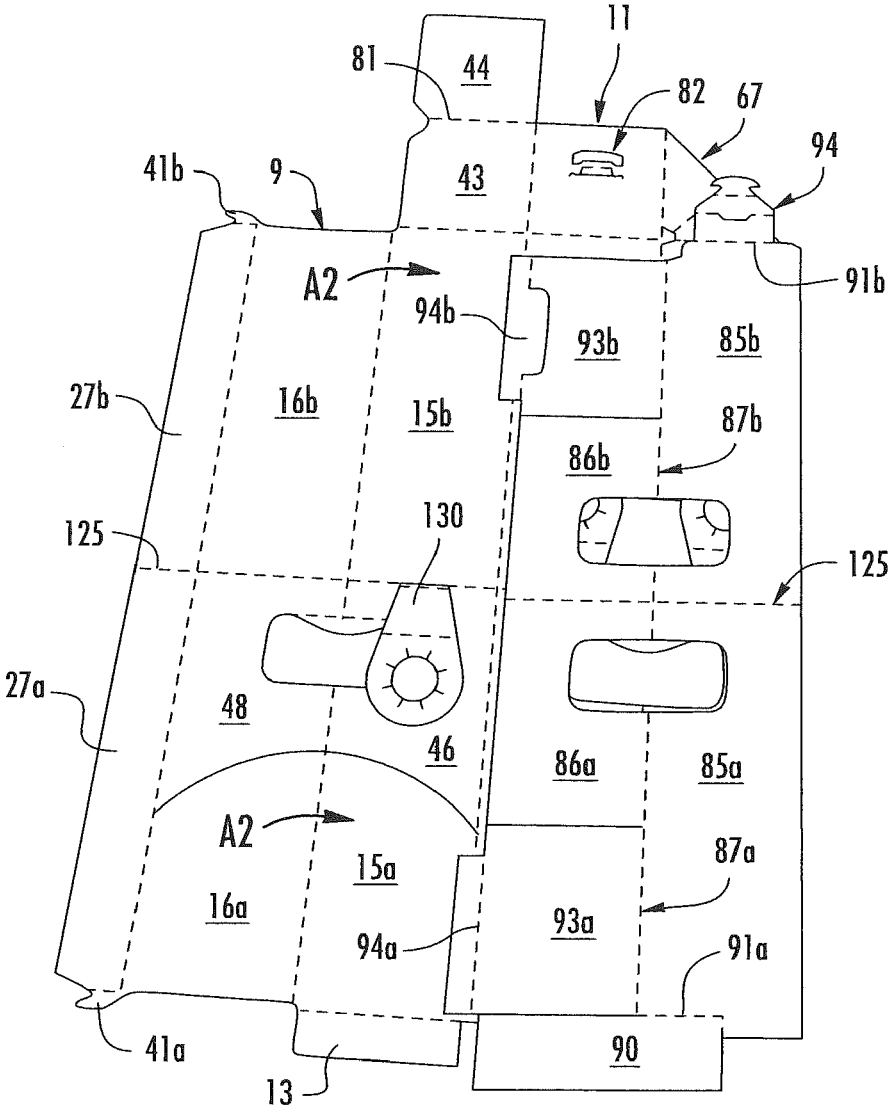
FIGS. 4-6 are views showing the folding of the carton blank to form a partially-erected carrier according to one embodiment of the disclosure. —9 illustrate the method of erecting the blank in FIG. 2
Figure 5:
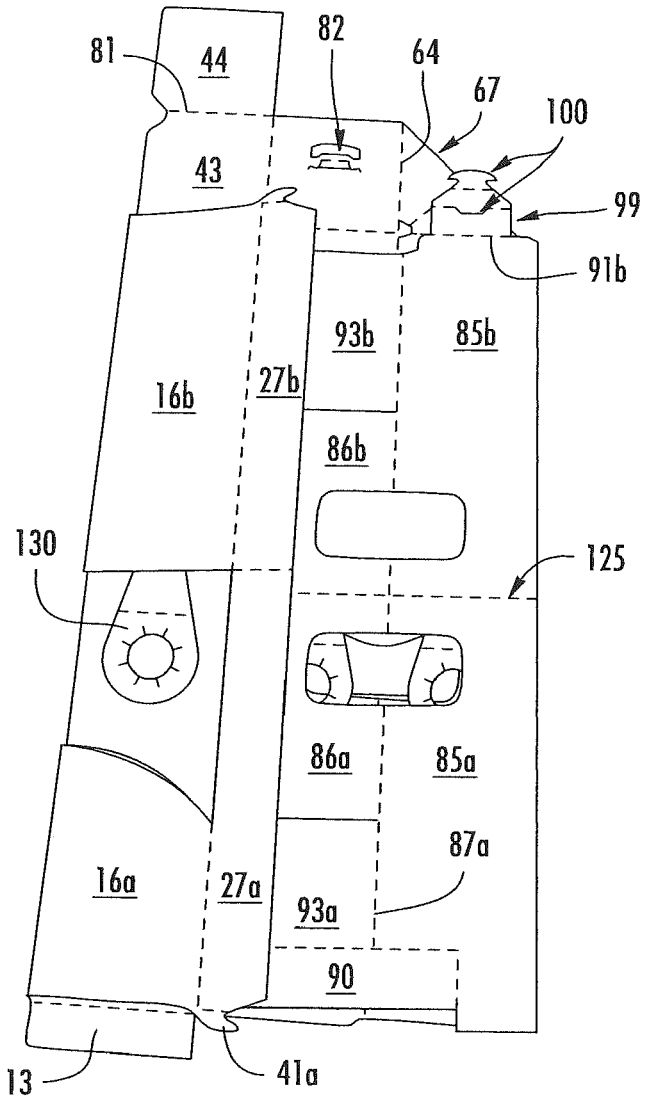
Figure 6:
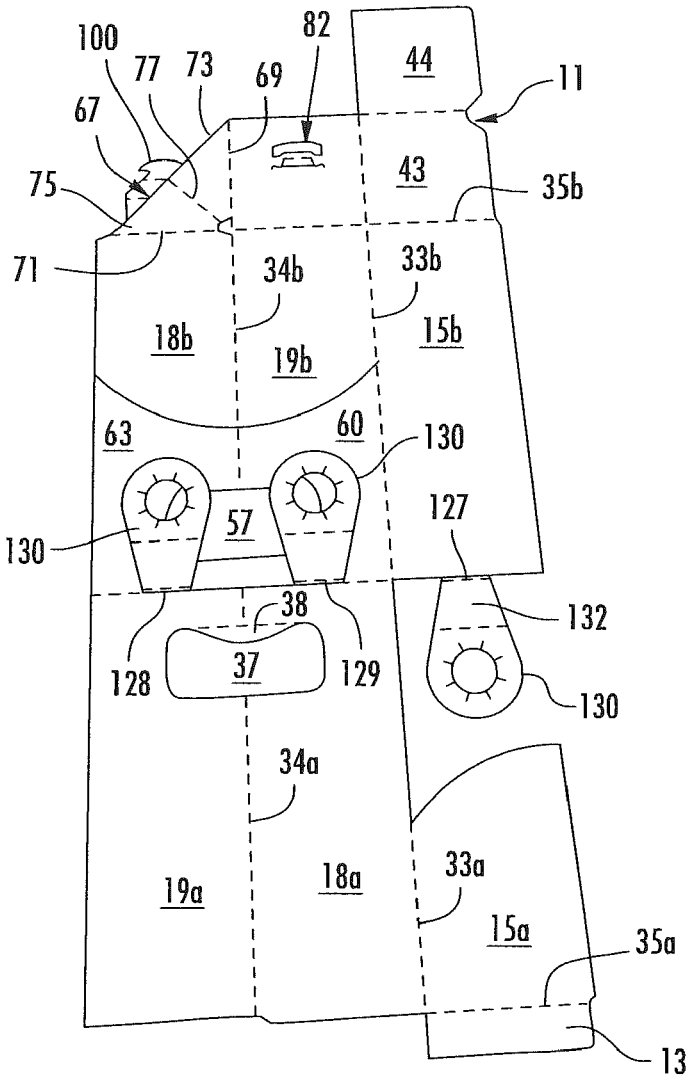
Figure 7:
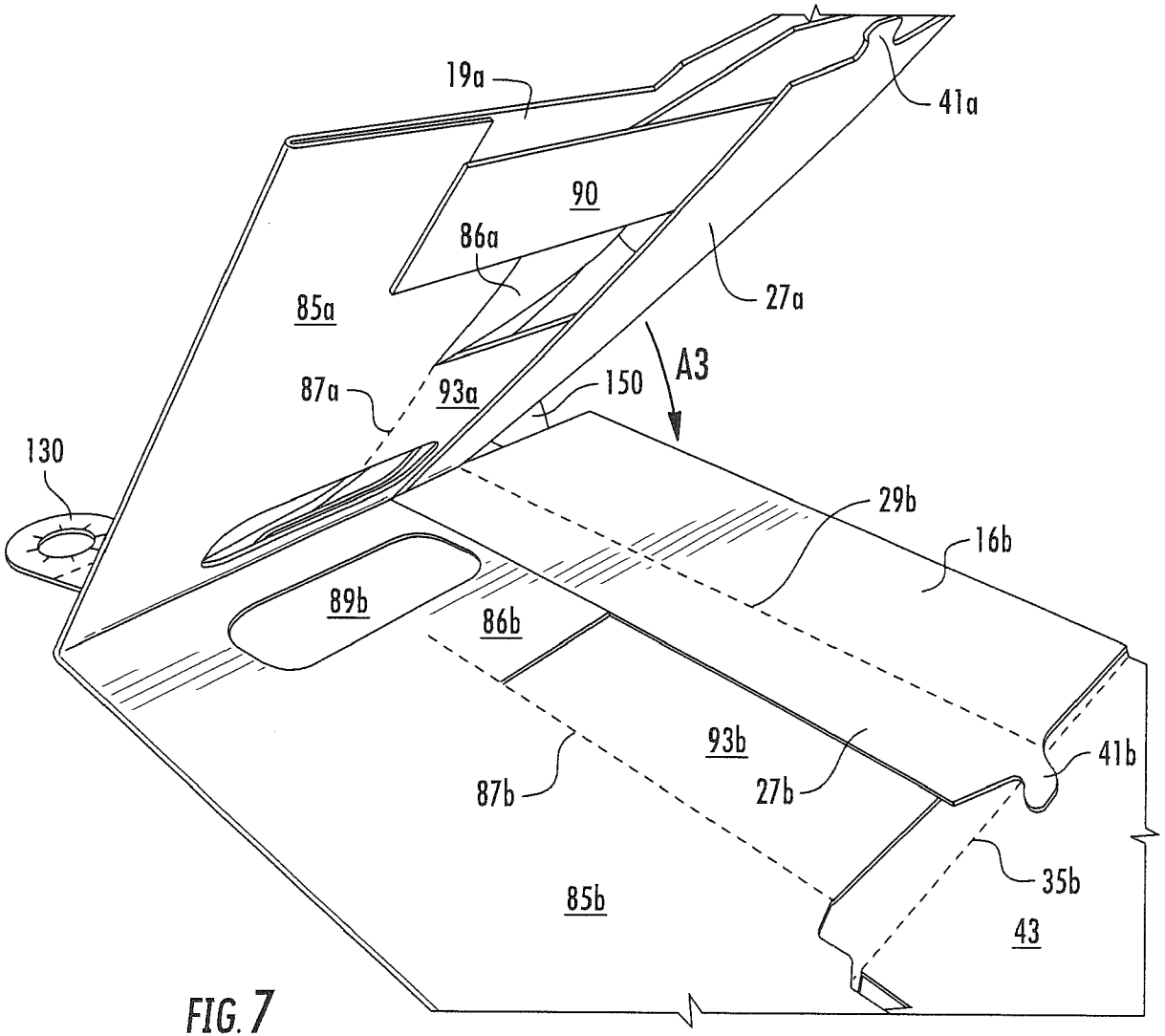
FIGS. 7 and 8 are views showing further folding of the partially-erected carrier of FIG. 6 into the carrier according to one embodiment of the disclosure.
Figure 8:
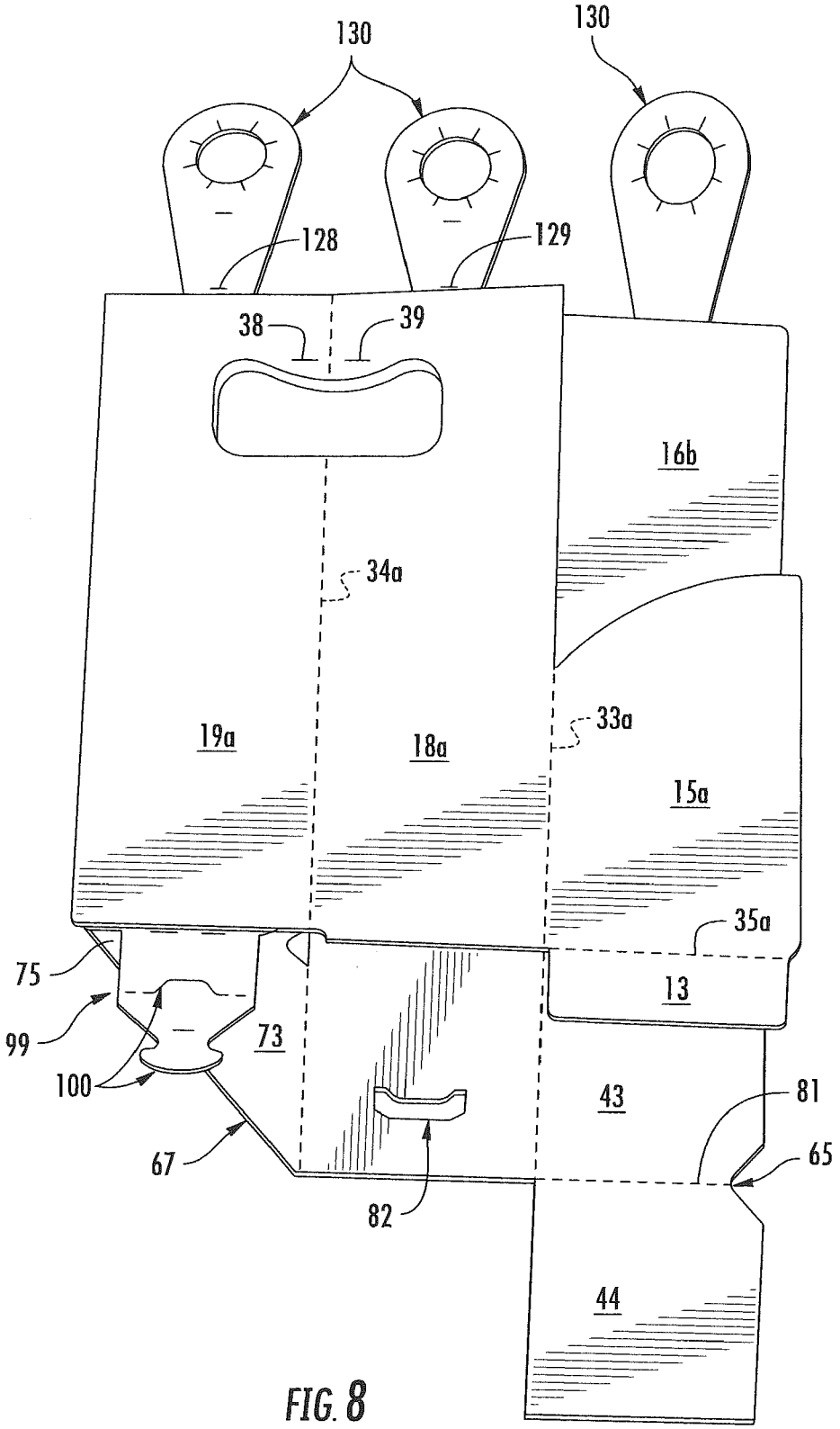

With reference to FIGS. 3-10, in one exemplary method of erection, the blank 3 is positioned with its exterior surface 1 facing down, as illustrated in FIG. 3. The carrier 5 may be erected from the blank 3 by respectively folding the central panels 83*a*, 83*b* in the direction of arrows A1 about fold lines 84*a*, 84*b* so that the central panels are in face-to-face relationship with portions the front and back panels 15*a*, 15*b*. Glue or other adhesive is selectively applied to the blank 3 to adhesively connect the adhesive flap 94*a* to the front panel 15*a* and to adhesively connect the adhesive flap 94*b* to the back panel 15*b*. Next, the keel 90 is folded about fold line 91 to be in face-to-face contact with the exterior surface 1 of the central panel 83*a*. Next, the upper portions 46 and 48 are pushed inward and the first side panels 16*a*, 16*b* are folded in the direction of arrows A2 (FIG. 4) about fold lines 31*a*, 31*b* so that the first side panels are in face-to-face contact with portions of the front and back panels 15*a*, 15*b*. As the side panels 16*a*, 16*b* are being folded the upper portions 46 and 48 of the first front panel 15*a* and first side panel 16*a* are inserted in between and adhesively secured to the second portion 86*a* of the central panel 83*a* and the second side panel 18*a*. As illustrated in FIG. 5, portions of the central panels 27*a*, 27*b* are in face-to-face contact with portions of the second portions 86*a*, 86*b* of the central panels 83*a*, 83*b* and the central panels 27*a*, 27*b* can be selectively adhesively secured thereto with glue. Upper portions 60 and 63 of the second back panel 19*b* and second side panel 18*b* may be adhesively secured with glue to the back central panel 83*b*.

Next, the partially assembled blank 3 is folded in the direction of arrow A3 (FIG. 7) about the longitudinal centerline CL so that the front portion 7 overlaps the back portion 9 and glue may be applied generally where indicated by "g" in FIG. 1 to the front and back central panels 83*a* 83*b*. The bottom panel 11 is attached to the bottom panel adhesive flap 13 by glue or by mechanical means. As shown in FIG. 9, the blank 3 is further assembled into the carrier by positioning the first side panels 16*a*, 16*b* and second side panels 18*a*, 18*b* to be in a generally spaced-apart, parallel planar relationship and positioning the front panel 15*a* and back panel 15*b* to be in a generally spaced-apart, parallel planar relationship. Such movement of the side panels 16*a*, 16*b*, 18*a*, 18*b* and front and back panels 15*a*, 15*b*, causes the divider flap 93*a* in the front portion of the carrier 5 to be positioned generally perpendicular to the central panel 83*a*. Accordingly, the divider flap 93*b* in the back portion of the carrier 5 to be positioned generally perpendicular to the central panel 83*b* and the back portion of the carrier is divided into two container receiving spaces 157 by the divider flap 93*b*. The first front panel 15*a*, first side panel 16*a*, and the front divider flap 93*a* form the first container-receiving space. The first back panel 15*b*, third side panel 16*b*, and the back divider flap 93*b* form the second container-receiving space. The second back panel 19*b*, fourth side panel 18*b*, and the back divider flap 93*b* form the third container-receiving space. The hooks 41*a*, 41*b* are also positioned into the notch 65 in the bottom panel to prevent the carrier from returning to its original configuration. Next the male locking features 100 of the attachment flap 99 are locked into place within the female locking features in the first portion 43 of the bottom panel 11.

Containers can be placed into the container receiving spaces 157 of the carrier 5. The bottoms of the containers are supported by the first and second portions 43, 44 of the bottom panel 11 of the carrier 5. The apertures 138 of the tamper resistant retention flaps 130 are aligned with the containers C and the retention flaps 130 are then pushed down into place past the cap CP to the neck of the containers C. The retention flaps 130 are attached to containers C to stabilize the containers in the spaces 157 of the carrier 5 and to provide indication that the containers have been removed from the carrier. If the carrier 5 has been tampered (i.e., the containers removed and then replaced) the retention flap 130 will be torn or damaged to provide visual indication of tampering. As shown in FIGS. 9 and 10, the container-receiving spaces 157 in the front portion and the back portion of the carrier 5 are substantially open along a top edge (e.g., an uppermost edge) of the carrier 5. As shown in FIG. 10, the container-receiving spaces 157 remain substantially open when the retention flaps 130 engage the containers C. Further, as shown in FIGS. 9 and 10, the retention flaps 130 are foldably connected to respective top edges (e.g., uppermost edges) of the respective first back panel 15*b*, second side panel 18*a*, and second front panel 19*a* along respective fold lines 127, 129, 128.

The exemplary carrier embodiment discussed above accommodates three containers arranged in two rows, but the present disclosure is not limited to these numbers. As one example, additional containers may be accommodated by increasing the size of the blank 3 (e.g., in the longitudinal direction L1 in FIG. 1) and forming additional container-receiving spaces therein. Also, the blank 3 could have less than three container-receiving spaces.

In general, the blank may be constructed from paperboard having a caliper so that it is heavier and more rigid than ordinary paper. The blank can also be constructed of other materials, such as cardboard, or any other material having properties suitable for enabling the carton to function at least generally as described above. The blank can be coated with, for example, a clay coating. The clay coating may then be printed over with product, advertising, and other information or images. The blanks may then be coated with a varnish to protect information printed on the blanks. The blanks may also be coated with, for example, a moisture barrier layer, on either or both sides of the blanks. The blanks can also be laminated to or coated with one or more sheet-like materials at selected panels or panel sections.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

In accordance with the exemplary embodiments, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed or depressed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line.

The above embodiments may be described as having one or more panels adhered together by glue during erection of the carton embodiments. The term "glue" is intended to encompass all manner of adhesives commonly used to secure carton panels in place.

The foregoing description of the disclosure illustrates and describes various exemplary embodiments. Various additions, modifications, changes, etc., could be made to the exemplary embodiments without departing from the spirit and scope of the disclosure. It is intended that all matter contained in the above description or shown in the accompanying drawings shall be interpreted as illustrative and not in a limiting sense. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carrier for holding a plurality of containers, the carrier comprising:

a plurality of panels that extends at least partially around an interior of the carrier, the plurality of panels comprising a bottom panel, at least one front panel, at least one back panel, at least two side panels, and at least one central panel dividing the interior of the carrier into a front portion and a back portion, the at least one front panel comprising at least a first front panel and a second front panel;

at least one front divider flap foldably connected to the at least one central panel and extending to the first front panel to divide the front portion into at least one front container-receiving space, at least one back divider flap is foldably connected to the at least one central panel and extending to the at least one back panel to divide the back portion into at least one back container-receiving space, at least one retention flap foldably connected to at least one of the at least one front panel, the at least one back panel, the at least two side panels, and the at least one central panel, the at least one retention flap engages a respective container of the plurality of containers and provides stability to the respective container in one of the at least one front container-receiving space and at least one back container-receiving space;

wherein the at least one retention flap comprises at least a first retention flap foldably connected to the at least one back panel and a second retention flap foldably connected to the second front panel, and the second front panel is spaced apart from the at least one back panel by the back portion;

wherein the at least one front container-receiving space and the at least one back container-receiving space are substantially open along a top edge of the carrier when the at least one retention flap engages the respective container of the plurality of containers.

2. The carrier of claim 1, wherein the at least one retention flap comprises an aperture for receiving a top portion of the respective container of the plurality of containers.

3. The carrier of claim 2, wherein the at least one retention flap comprises a base portion foldably connected to one of the at least one front panel, the at least one back panel, the at least two side panels, and the at least one central panel and a distal portion foldably connected to the base portion, the distal portion comprises the aperture.

4. The carrier of claim 3, wherein the distal portion comprises a plurality of tabs adjacent the aperture, the plurality of tabs being defined by cuts extending from the aperture.

5. The carrier of claim 1, wherein the at least one retention flap is foldably connected at the top edge of the carrier.

6. The carrier of claim 1, wherein the at least one back panel comprises a first back panel and a second back panel, and the at least two side panels comprise a first side panel, a second side panel, a third side panel, and a fourth side panel, the first front panel is foldably connected to the first side panel at a first fold line and the second side panel at a second fold line, the second front panel is foldably connected to the second side panel at a third fold line; the first back panel is foldably connected to the third side panel at a fourth fold line and the second back panel at a fifth fold line, the second back panel is foldably connected to the fourth side panel at a sixth fold line.

7. The carrier of claim 6, wherein the at least one retention flap further comprises a third retention flap, the first retention flap is foldably connected to the first back panel, the second retention flap is foldably connected to the second front panel, and the third retention flap is foldably connected to the second side panel.

8. The carrier of claim 6, wherein the at least one container-receiving space comprises a first container-receiving space, a second container-receiving space, and a third container-receiving space.

9. The carrier of claim 8, further comprising a first handle aperture in the second side panel and the second front panel, and a second handle aperture in the first central panel, the first handle aperture is aligned with the second handle aperture.

10. The carrier of claim 9, further comprising a third handle aperture at least partially in the second back panel and the fourth side panel, and a fourth handle aperture in the second central panel, the third handle aperture is aligned with the fourth handle aperture.

11. The carrier of claim 10, further comprising a fifth handle aperture in the first front panel and the first side panel, at least a portion of the first handle aperture, the second handle aperture, the third handle aperture, the fourth handle aperture and the fifth handle aperture align and form a handle opening in the carrier.

12. The carrier of claim 8, wherein the first front panel, first side panel, and the at least one front divider flap form the first container-receiving space, the first back panel, third side panel, and the at least one back divider flap form the second container-receiving space, and the second back panel, fourth side panel, and the at least one back divider flap form the third container-receiving space.

13. The carrier of claim 12, wherein the at least one retention flap further comprises a third retention flap, the first article retention flap is foldably connected to the first back panel, the second article retention flap is foldably connected to the second front panel, and the third article retention flap is foldably connected to the second side panel.

14. A carrier for holding a plurality of containers, the carrier comprising:

a plurality of panels that extends at least partially around an interior of the carrier, the plurality of panels comprising a bottom panel, at least one front panel, at least one back panel, at least two side panels, and at least one central panel dividing the interior of the carrier into a front portion and a back portion;

at least one front divider flap foldably connected to the at least one central panel and extending to the at least one front panel to divide the front portion into at least one front container-receiving space, at least one back divider flap is foldably connected to the at least one central panel and extending to the at least one back panel to divide the back portion into at least one back container-receiving space, at least one retention flap foldably connected to at least one of the at least one front panel, the at least one back panel, the at least two side panels, and the at least one central panel, the at least one retention flap engages a respective container of the plurality of containers and provides stability to the respective container in one of the at least one front container-receiving space and at least one back container-receiving space;

wherein that at least two side panels comprises a first side panel, a second side panel, a third side panel, and a fourth side panel, the at least one back panel comprises a first back panel and a second back panel, the at least one front container-receiving space comprises a front container-receiving space at least partially defined by the central panel, the at least one front panel, the first side panel, and the second side panel, and the at least one back container receiving space comprises a first back container-receiving space at least partially defined by the central panel, the first back panel, and the third side panel, and a second back container-receiving space adjacent the first back container-receiving space and at least partially defined by the central panel, the second back panel, and the fourth side panel.

15. The carrier of claim 14, wherein the first side panel, the second side panel, the third side panel, and the fourth side panel are orthogonal to the central panel, the first side panel is coplanar with the third side panel, and the second side panel is noncoplanar with the fourth side panel.

16. The carrier of claim 15, further comprising a back divider flap extending from the central panel and at least partially defining the first back container-receiving space and the second back container-receiving space.

17. The carrier of claim 1, wherein the at least one retention flap is foldably connected to the at least one of the at least one front panel, the at least one back panel, the at least two side panels, and the at least one central panel at the top edge of the carrier.

18. A carrier for holding a plurality of containers, the carrier comprising:

a plurality of panels that extends at least partially around an interior of the carrier, the plurality of panels comprising a bottom panel, at least one front panel, at least one back panel, at least two side panels, and at least one central panel dividing the interior of the carrier into a front portion and a back portion;

at least one front divider flap foldably connected to the at least one central panel and extending to the at least one front panel to divide the front portion into at least one front container-receiving space;

at least one back divider flap is foldably connected to the at least one central panel and extending to the at least one back panel to divide the back portion into at least one back container-receiving space; and at least a first retention flap and a second retention flap, the first retention flap is foldably connected to a first panel, the second retention flap is foldably connected to a second panel, the first panel is one of the at least one front panel and the at least one back panel, the second panel is one of the at least two side panels, and the first panel and the second panel are nonparallel to one another, each of the first retention flap and the second retention flap engages a respective container of the plurality of containers and provides stability to the respective container in one of the at least one front container-receiving space and at least one back container-receiving space;

wherein the at least one front container-receiving space and the at least one back container-receiving space are substantially open along a top edge of the carrier when the first retention flap and the second retention flap engage the respective containers of the plurality of containers.

* * * * *